US006151992A

United States Patent [19]

Larimer

[11] Patent Number: 6,151,992

[45] Date of Patent: Nov. 28, 2000

[54] CORK EXTRACTOR

[75] Inventor: Robert W. Larimer, New York, N.Y.

[73] Assignee: Metrokane, Inc., New York, N.Y.

[21] Appl. No.: 09/227,460

[22] Filed: Jan. 8, 1999

[51] Int. Cl.[7] ..... B67B 7/18

[52] U.S. Cl. ..... 81/3.29; 81/3.45

[58] Field of Search ..... 81/3.07, 3.08, 81/3.09, 3.36, 3.29, 3.45, 3.48, 3.49, 180.1, 184, 177.6; 7/151, 155, 156

[56] References Cited

U.S. PATENT DOCUMENTS

| | | | |
|---|---|---|---|
| 171,752 | 1/1876 | Witte | 7/155 |
| D. 358,744 | 5/1995 | Entwistle . | |
| D. 359,213 | 6/1995 | Entwistle | 81/3.29 |
| D. 364,324 | 11/1995 | Entwistle . | |
| 613,288 | 11/1898 | Mazzanovich | 81/3.45 |
| 814,834 | 3/1906 | Coughlin | 81/3.45 |
| 1,248,608 | 12/1917 | Brown . | |
| 2,115,289 | 4/1938 | Smythe . | |
| 2,886,994 | 5/1959 | Hanson | 81/3.09 |
| 4,276,789 | 7/1981 | Allen . | |
| 4,572,034 | 2/1986 | Lee . | |
| 4,574,663 | 3/1986 | Delisle . | |
| 4,580,303 | 4/1986 | Henshaw | 81/3.45 |
| 4,703,673 | 11/1987 | Allen . | |
| 4,750,391 | 6/1988 | Sweatt . | |
| 5,351,579 | 10/1994 | Metz et al. . | |
| 5,361,652 | 11/1994 | Andina . | |
| 5,367,923 | 11/1994 | Fabbro . | |
| 5,799,551 | 9/1998 | Vitrac | 81/3.45 |

*Primary Examiner*—David A. Scherbel
*Assistant Examiner*—Joni B. Danganan
*Attorney, Agent, or Firm*—SAIDMAN DesignLaw Group

[57] ABSTRACT

A self-pulling cork extractor having a guide and a corkscrew which may be stored entirely within the guide for compact and safe storage and transport. The corkscrew includes a worm having a sharp free end attached to a handle having downwardly and inwardly foldable end portions. The end portions are upwardly and outwardly extended and the corkscrew is positioned within the guide with the free end downwardly oriented for extraction of a cork, lateral movement of the corkscrew being limited by an aperture located at the top of the guide. For storage and transport, the end portions are downwardly and inwardly folded and the corkscrew inserted upwardly through the lower portion of the guide and retained completely therein. In the storage position, the sharp free end of the worm is positioned within the aperture at the top of the guide, thereby preventing the exposure of any sharp edges or points. A foil cutter is also integrally formed in the guide.

33 Claims, 11 Drawing Sheets

CORK EXTRACTOR

BACKGROUND OF THE INVENTION

1. Field of the Invention

This invention relates to an apparatus for removing a cork from a bottle, such as a wine bottle.

2. Description of Related Art

Self-pulling cork extractors are well-known in the art. For example, the patent to Allen, U.S. Pat. No. 4,703,673 (the "'673 patent"), discloses an extractor comprising a holder, an elongated handle and a movable portion including a helical corkscrew. The holder is provided to engage the neck of a bottle (such as a wine bottle) and position and guide the corkscrew into the cork. The handle is designed to be attached to the top of the corkscrew and extend radially therefrom. The handle further includes an elongated arm having a formation on the end distal the corkscrew to engage a human finger and restrain such finger from outward movement with respect to the arm. The device is operated by driving the corkscrew, which has a sharpened tip, into the cork by rotating the corkscrew (by radially rotating the handle) and simultaneously applying downward pressure until the lip of the bottle abuts a "stop shoulder" in the base of the holder. Further rotation of the corkscrew, without further upward movement of the bottle, will draw the cork upwardly along the corkscrew, thereby extracting it from the bottle.

Attempts have been made to provide a cork extractor which can be stored and transported easily and safely. For example, the handle of the '673 patent is removable and contains a bore which is adapted to be inserted through the lower end of the base and over the corkscrew. While this configuration provides for safe storage and transport, the elongated handle exerts large angular stress on the corkscrew during axial rotation, thereby causing excessive wear-and-tear on the aperture which guides the corkscrew and may result in difficulty in driving the corkscrew straight into the cork.

The Entwistle patent (U.S. Pat. No. Des. 364,324) also illustrates a cork extractor of the self-pulling type which comprises a guide member having a separable handle from which the worm extends. An aperture is located in the upper portion of the guide member through which the worm is inserted. Cutting wheels are located on the inner surface of the lower portion of the guide member just below the reaction surface of the guide member, which assist in removing the foil from the bottle. The handle is stored in the guide member in the same manner in which it is positioned during use, leaving the sharp tip of the worm disadvantageously exposed.

The Delisle patent (U.S. Pat. No. 4,574,663) discloses a corkscrew worm that is encased during transport and storage, thereby minimizing risk to the user. However, this corkscrew is not of the self-pulling type but rather relies on fulcrum created with the neck of the bottle for cork extraction.

OBJECTS AND SUMMARY OF THE INVENTION

It is a primary object of the present invention to provide a self-pulling cork extractor that can be stored and transported without any exposed sharp points or edges.

It is another object of the present invention to provide a two-piece self-pulling cork extractor that is compact and can be easily and safely stored and transported.

It is another object of the present invention to provide a cork extractor that has a minimum number of separable members while providing built-in foil cutters.

It is yet a further object of the present invention to provide a cork extractor that is aesthetically pleasing and easy to operate.

It is a further object of the present invention to provide a cork extractor that is uncomplicated and inexpensive to produce.

The present invention overcomes the difficulties described above through the provision of a self-pulling cork extractor comprising a corkscrew and a guide or holder. The guide or holder not only aligns and guides the corkscrew when extracting a cork from a bottle to be opened, but also retains the corkscrew entirely within the guide for storage and transport in a compact and safe fashion. This is accomplished in part by providing a corkscrew handle having a pair of foldable end portions. With the handle in its folded position, the corkscrew is stored within the guide in an orientation inverse to the orientation of the corkscrew when extracting a cork.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
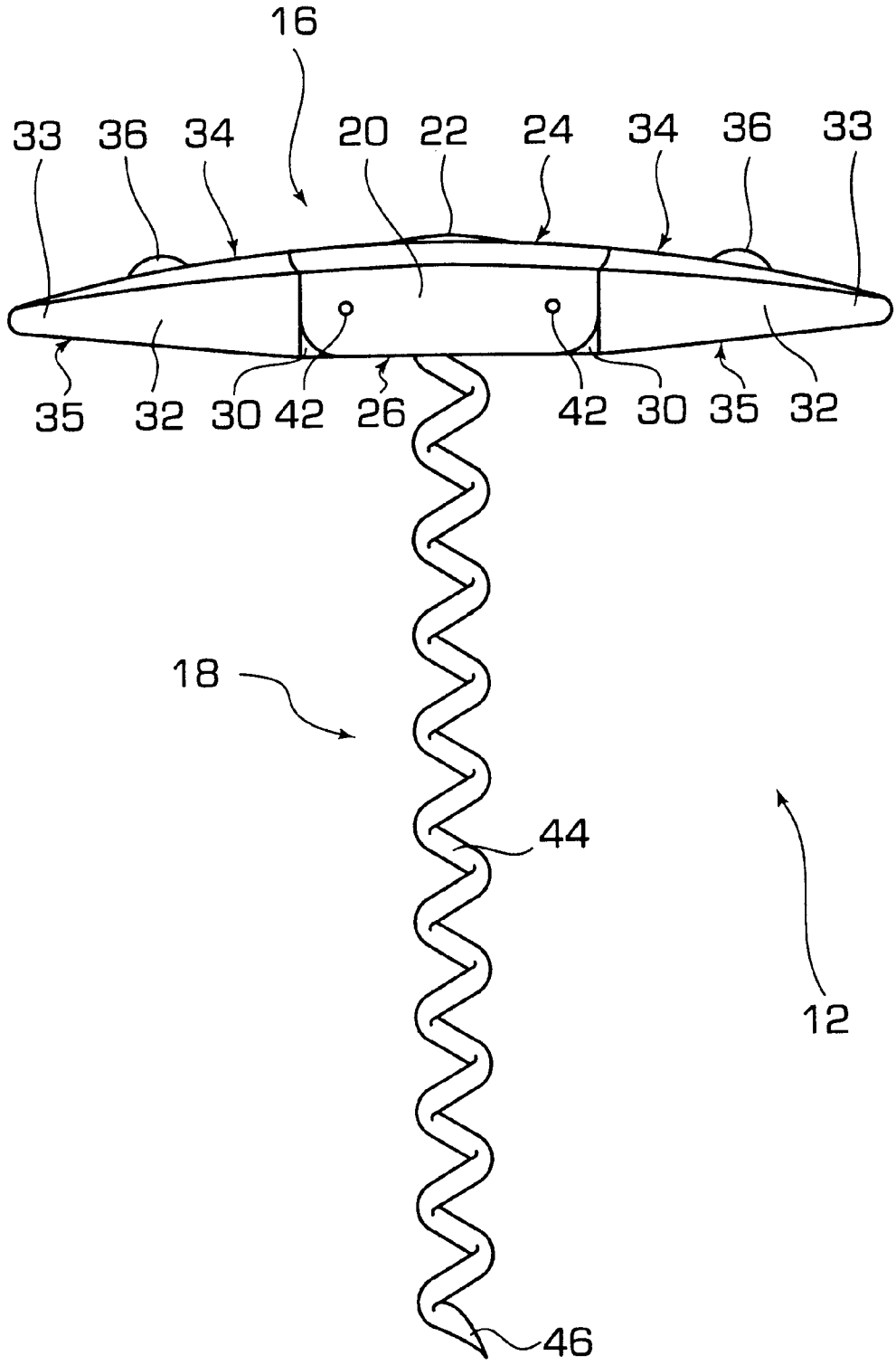
FIG. 1 is a front view of a preferred embodiment of the corkscrew component of the present invention shown in its unfolded or "in use" position.

Throughout this specification, terms such as "top", "bottom", 'upper', "lower", etc. will be used with reference to the apparatus as illustrated in the drawings and as it would likely be positioned for use atop an upright bottle. As will be made clear by the specification, the present invention can be operated, stored, or transported in a variety of positions and orientations. Thus, such terms are intended merely to aid in describing the present invention and are not intended to be limiting in any way.

Figure 5:
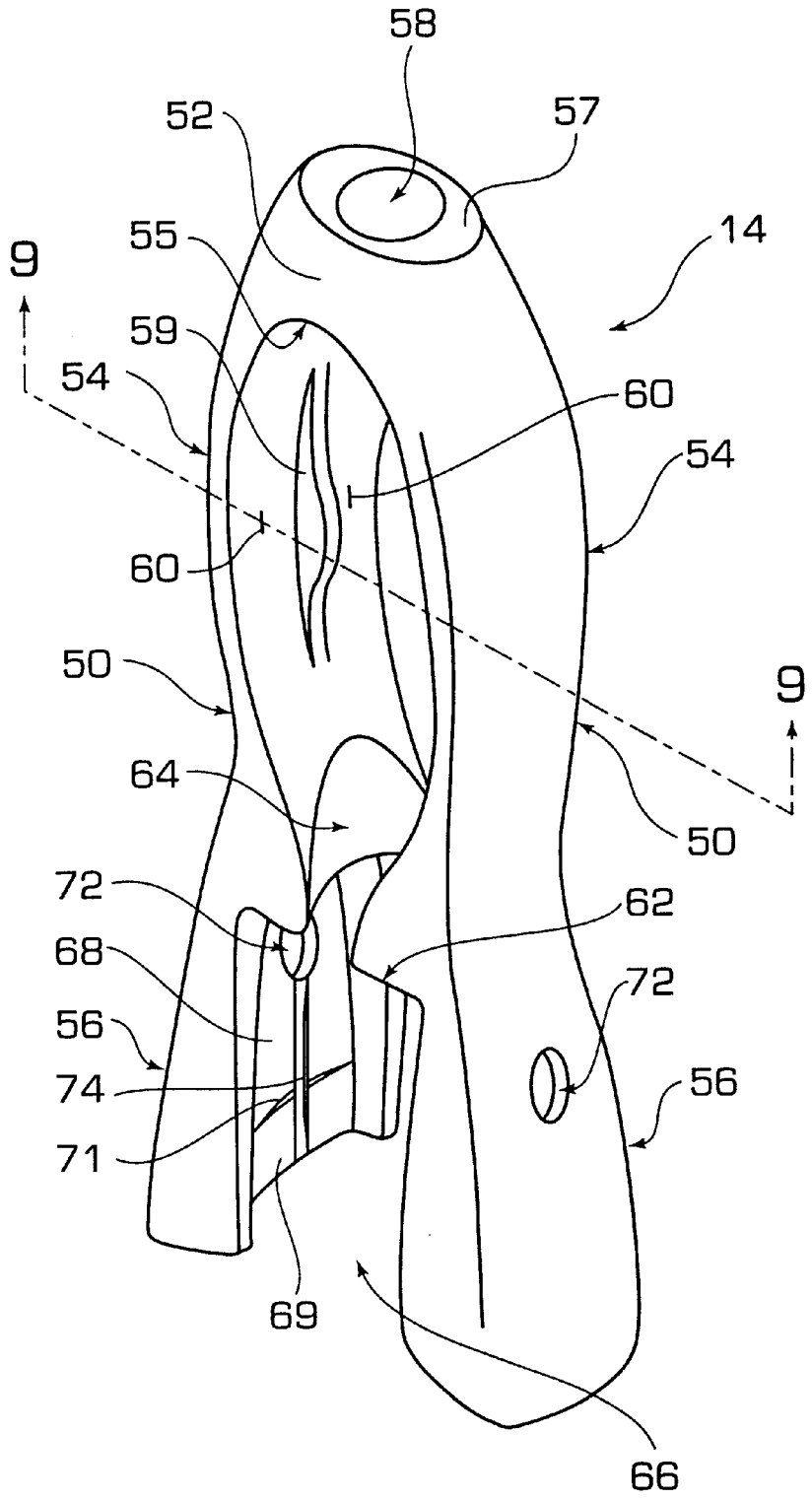
FIG. 5 is a perspective view of a preferred embodiment of the guide or holder of the present invention.

The preferred embodiment of the present invention comprises a self-pulling cork extractor which generally includes two completely separable and individually integral components: a corkscrew 12 as shown in FIG. 1, and a holder or guide 14 as shown in FIG. 5, which cooperate with each other in a manner to be described in more detail hereinbelow.

Referring first to FIG. 1, corkscrew 12 generally includes a handle 16 from which perpendicularly extends a helical worm 18. Worm 18 is conventional and comprises an elongated helical body 44 preferably made of metal which may be coated with a friction-reducing material such as Teflon™. The friction-reducing coating enables the worm to be driven into a cork more easily, as is well-known. Worm 18 also includes a sharpened free end 46 and a distal end which is embedded in handle 16 in a manner to be described below.

Handle 16 includes a substantially rectangular center portion 20 from both sides of which extend two preferably identical end portions 32. Each end portion 32 is somewhat triangularly shaped, having gently curved sides that taper to a rounded tip 33. Center portion 20 and end portions 32 are preferably made of plastic having a high tensile strength, which may be coated with rubberized paint to provide an easy and attractive surface for the hands of the user to grip.

Center portion 20 also preferably includes a gently curved top surface 24 which aligns with the top surfaces 34 of end portions 32 when end portions 32 are in the position shown in FIG. 1 (called the "unfolded position"). Center portion 20 further preferably includes a substantially planar lower surface 26 which aligns with the lower surfaces 35 of end portions 32 in the unfolded position.

Figure 3:
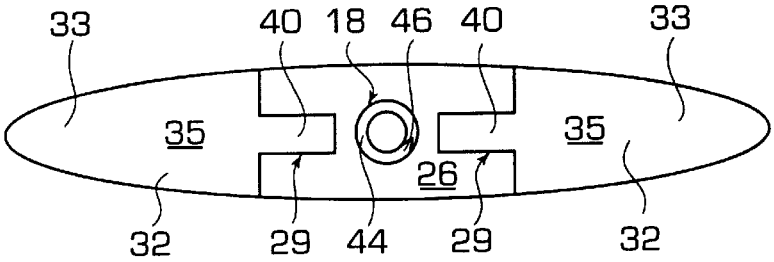
FIG. 3 is a bottom view of the corkscrew of FIG. 1.
Figure 4:
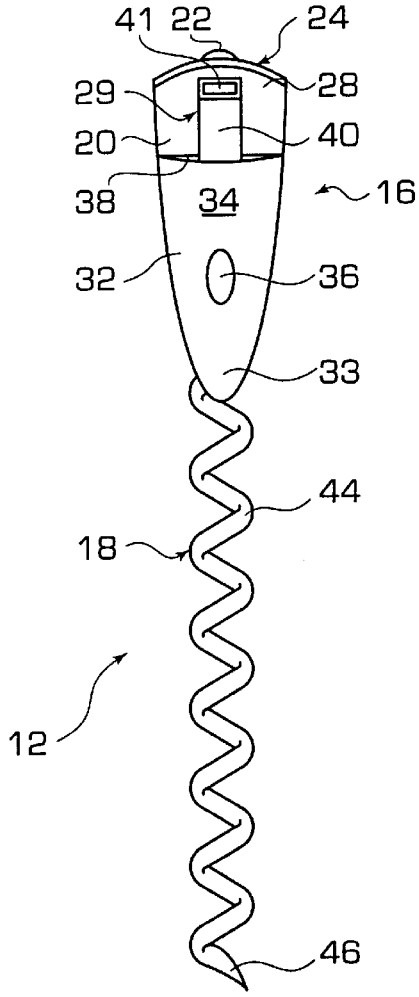
FIG. 4 is a side view of the corkscrew shown in its folded or storage position.

Both of the end portions 32 are pivotally mounted to center portion 20. As seen in FIG. 3, center portion 20 preferably includes a pair of oppositely-extending U-shaped yokes 29. Each end portion 32 includes an inwardly extending flange 40 which mates with U-shaped yoke 29. Referring back to FIG. 1, a pin 42 extends transversely through each of the U-shaped yokes 29 of center portion 20 and flange 40 of end portions 32 so that end portions 32 are enabled to pivot downwardly about pins 42 to the folded position shown in FIG. 4.

As seen again in FIG. 1, the lower surface 26 of center portion 20 terminates in rounded lower edges 30 which extend the width of center portion 20. Rounded lower edges 30 allow end portions 32 to smoothly pivot between their unfolded and folded positions.

Figure 2:
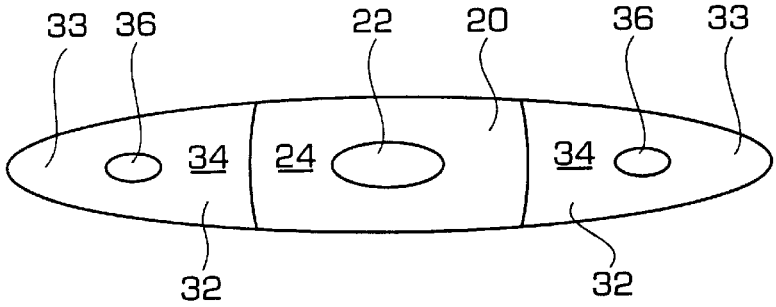
FIG. 2 is a top view of the corkscrew of FIG. 1.

Referring to FIG. 2, each end portion 32 also preferably includes an oval-shaped nib 36 centrally located on top surface 34. The function of nibs 36 will be described in greater detail hereinbelow. A clear, rounded protrusion 22 may optionally be centrally located on top surface 24 of center portion 20 for the display, for example, of a trademark and/or company name of the manufacturer.

As noted above, FIG. 4 shows end portions 32 in their "folded" or "storage" position. When end portions 32 are in their folded position, it exposes two gently arched side surfaces 28 on center portion 20. Side surfaces 28, which are generally vertically oriented, mate with similarly arched end surfaces 38 of end portions 32 when handle 16 is in the unfolded position. A spring 41 may be provided above flange 40 to assist end portion 32 to remain in its folded and unfolded positions.

Referring now to FIGS. 5–8, the other component of the present invention, the guide or holder 14, will now be described in greater detail. As with handle 12, guide 14 is preferably made of plastic having a high tensile strength, and may be coated with rubberized paint to provide an aesthetically pleasing and improved surface for the hands of the user to grip. Guide 14 comprises two opposing elongated arms 50 which are joined by a head 52. Arms 50 each generally include an upper portion 54 which extends downwardly from head 52 and a lower portion 56. Positioned approximately at the junction between upper and lower portions 54 and 56 is a substantially planar reaction surface 62, the function of which will be described in greater detail below.

Arms 50 define open sides 66 therebetween which allow arms 50 to flex both towards and away from each other, thus enabling lower portion 56 to fit over a variety of bottle neck sizes and shapes, as will be described in greater detail below. Each upper portion 54 also preferably includes a substantially cylindrical cork receiving surface 64 extending upwardly from reaction surface 62.

Head 52 includes a substantially planar top surface 57 and a lower surface 55. A cylindrical aperture 58 is centrally located in head 52 and extends between top surface 57 and lower surface 55 and is longitudinally oriented with respect to the longitudinal axis of guide 14. Aperture 58 receives and guides corkscrew 12 during the extraction of a cork, as will be described below. The diameter of aperture 58 is slightly larger than the diameter of worm 18 so as to allow worm 18 to be inserted therethrough while, at the same time, preventing substantial lateral movement of worm 18 during extraction of a cork.

A pair of inwardly facing, opposing arcuate projections 59 are preferably located on the inside surface of upper portion 54 of each arm 50. Projections 59 cooperate to prevent radial rotation of a cork during extraction thereof, as is conventional. Each upper portion 54 also may include a pair of foil cutter tips 60, which operate in conjunction with projections 59 (in a manner to be set forth below) to cut the foil that generally envelopes the neck of a wine bottle. Foil cutter tips 60 are generally oriented in a plane which is parallel to the longitudinal axis of guide 14, are preferably made of metal, for durability, and are relatively thin, thereby allowing tips 60 to cut through foil. Tips 60 are preferably rounded and do not have sharpened edges as to avoid cutting a user of the present invention.

Figure 6:
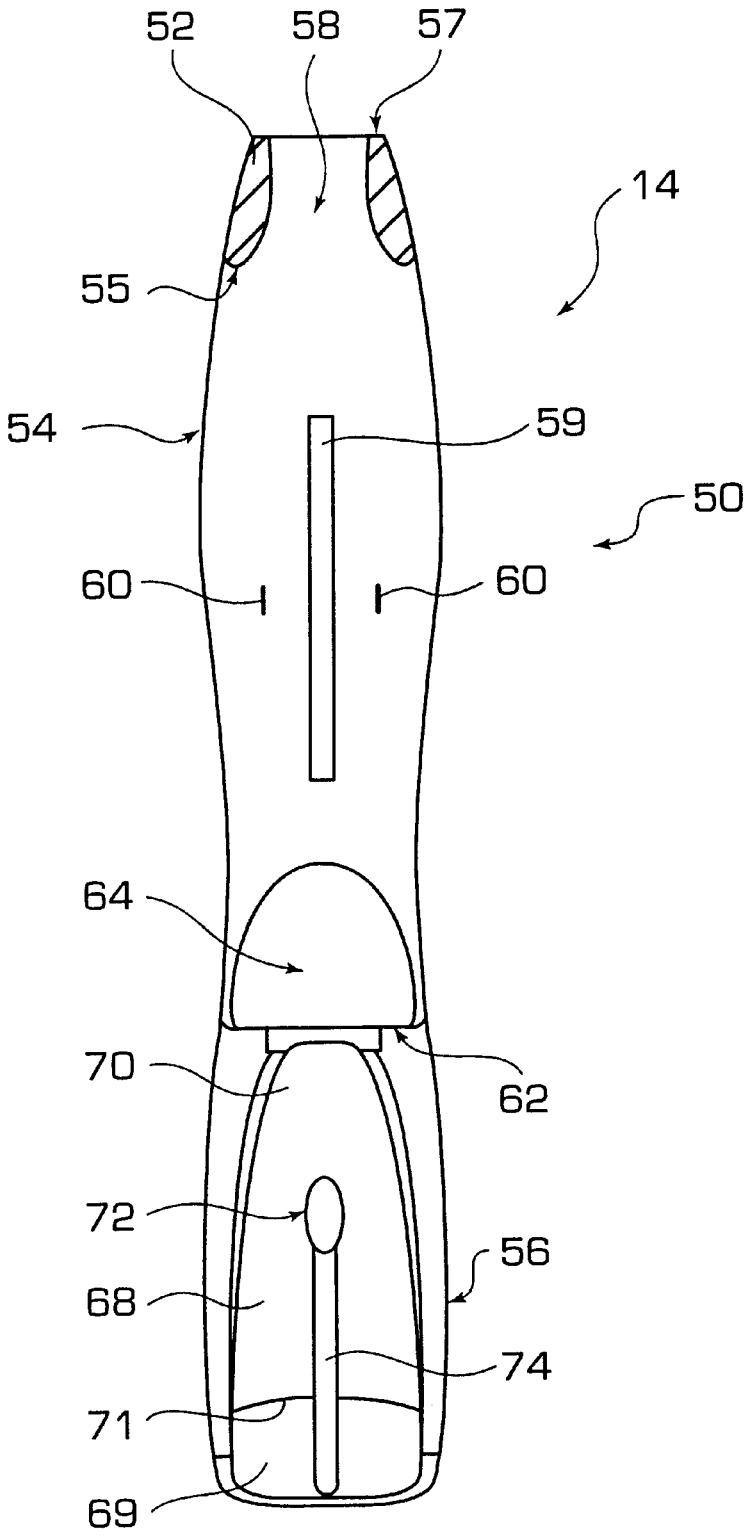
FIG. 6 is a longitudinal sectional plan view showing one of the identical opposing arms of the guide.
Figure 7:
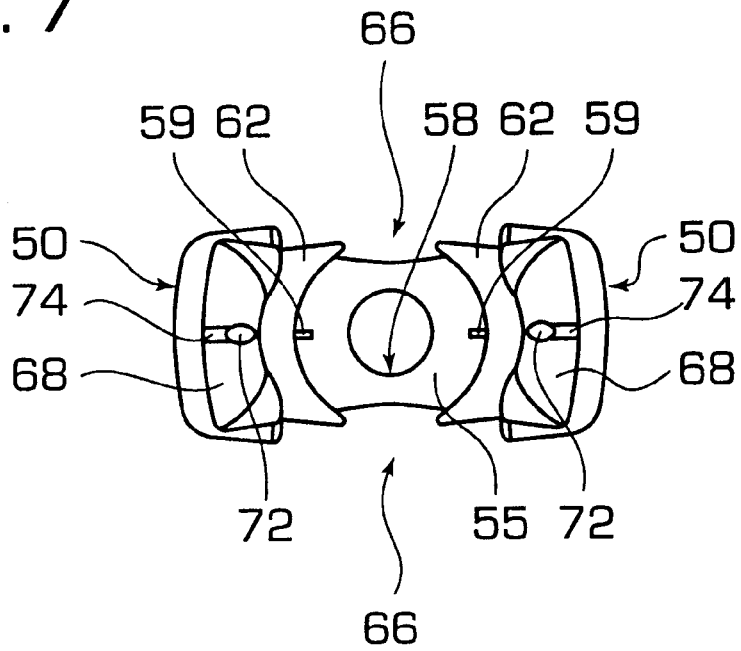
FIG. 7 is a bottom view of the guide.
Figure 8:
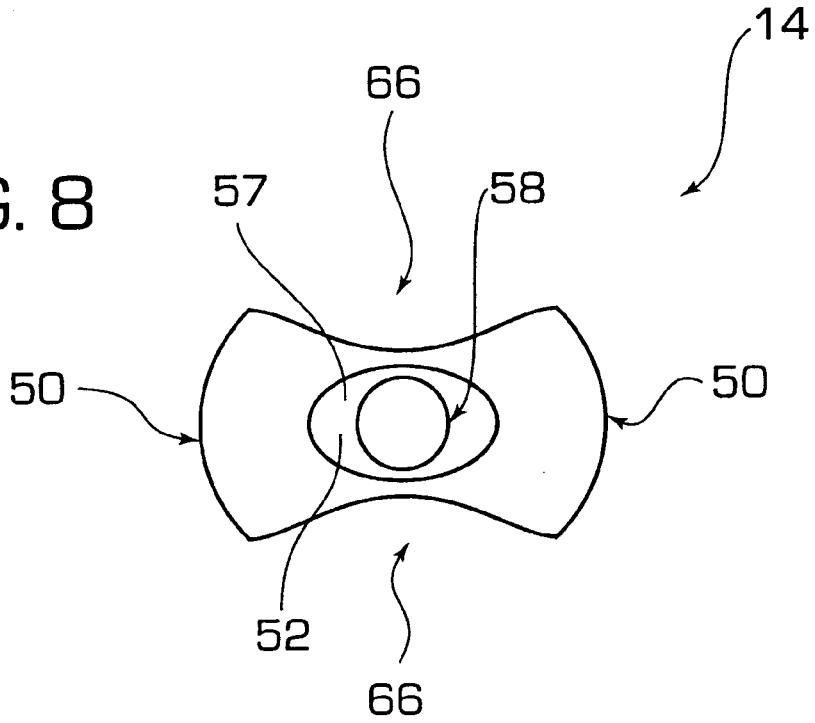
FIG. 8 is a top view of the guide.

As is most clearly seen in FIG. 6, the lower portion of each arm 50 includes a recess 68 having a fairly wide tail 69 at the bottom of arm 50 which gently tapers upwardly to a rounded tip 70. Each recess 68 further preferably includes a transverse arcuate ridge 71, a narrow elongated groove 74 which extends upwardly from tail 69, and an aperture 72 which is approximately centrally located in recess 68. These elements all function to enable the handle of the present invention to be stored within the guide, as will be described in more detail hereinbelow.

The process of opening a wine bottle generally involves two steps: (1) removing a foil wrapper from the lip of the bottle to expose the cork, and (2) extracting the cork.

Figure 9:
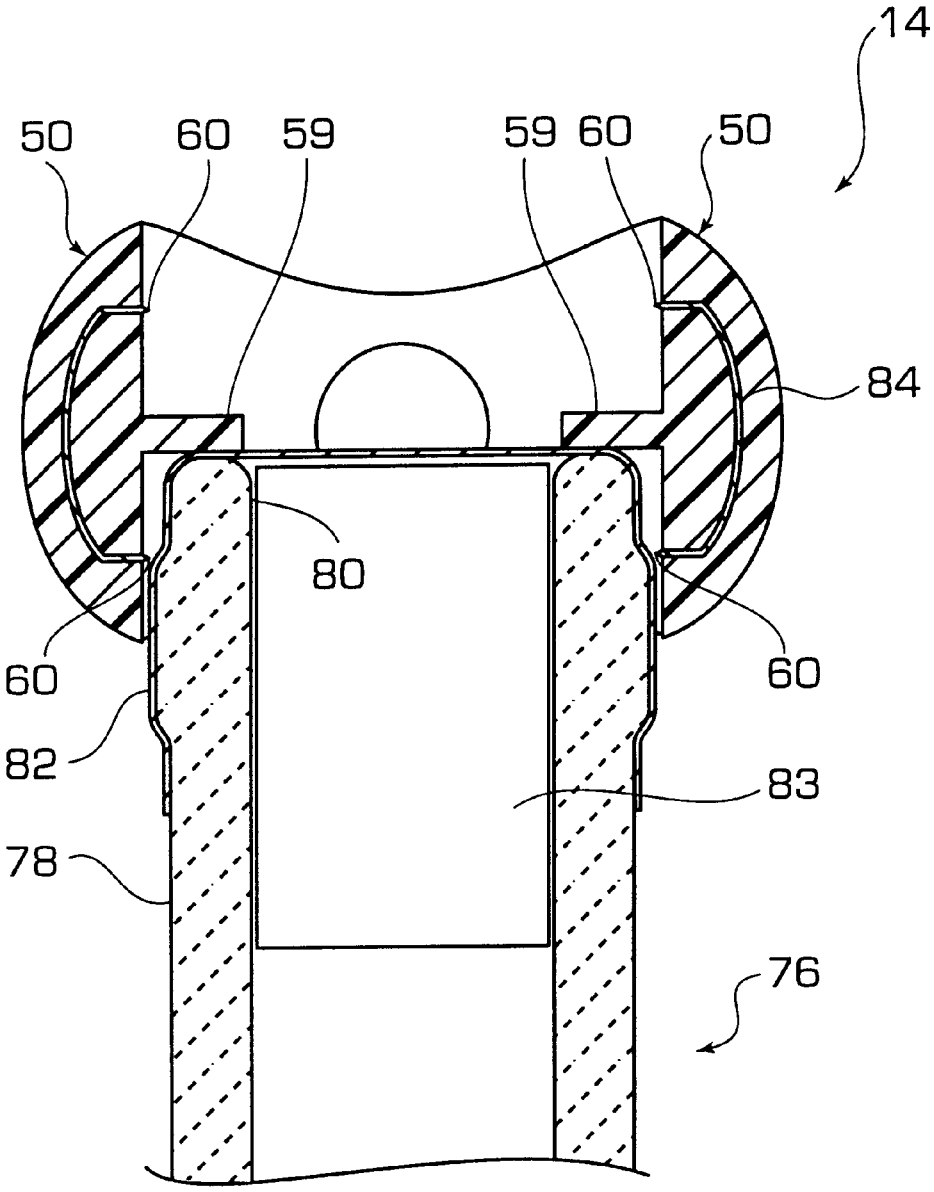
FIG. 9 is a transverse sectional diagrammatic view showing the upper portion of the guide positioned atop the neck of a bottle.

FIG. 9 illustrates the way in which the present invention facilitates the removal of a foil wrapper. FIG. 9 is a cross-sectional view taken along 9—9 of FIG. 5 which shows a bottle 76 positioned in guide 14. Bottle 76 has a neck 78 and a lip 80. The uppermost portion of neck 78 is enveloped by a foil wrapper 82. A cylindrical cork 83, having a diameter approximately equal to the inner diameter of neck 78, is also located within neck 78 and extends upwardly approximately to lip 80.

In order to cut foil wrapper 82, guide 14 is oriented so that its longitudinal axis is perpendicular to the axis of neck 78. Upper portion 54 of guide 14 is lowered upon lip 80 until projections 59 are generally centered over lip 80 and resting thereupon. Arms 50 are gently squeezed towards each other by the user, bringing foil cutter tips 60 closer together until one pair of tips 60 pierce foil wrapper 82. Guide 14 is then manually rotated about neck 78 until a circular cut is made around the perimeter of foil wrapper 82. The top of foil wrapper 82 may then be easily removed, exposing cork 83.

Figure 10:
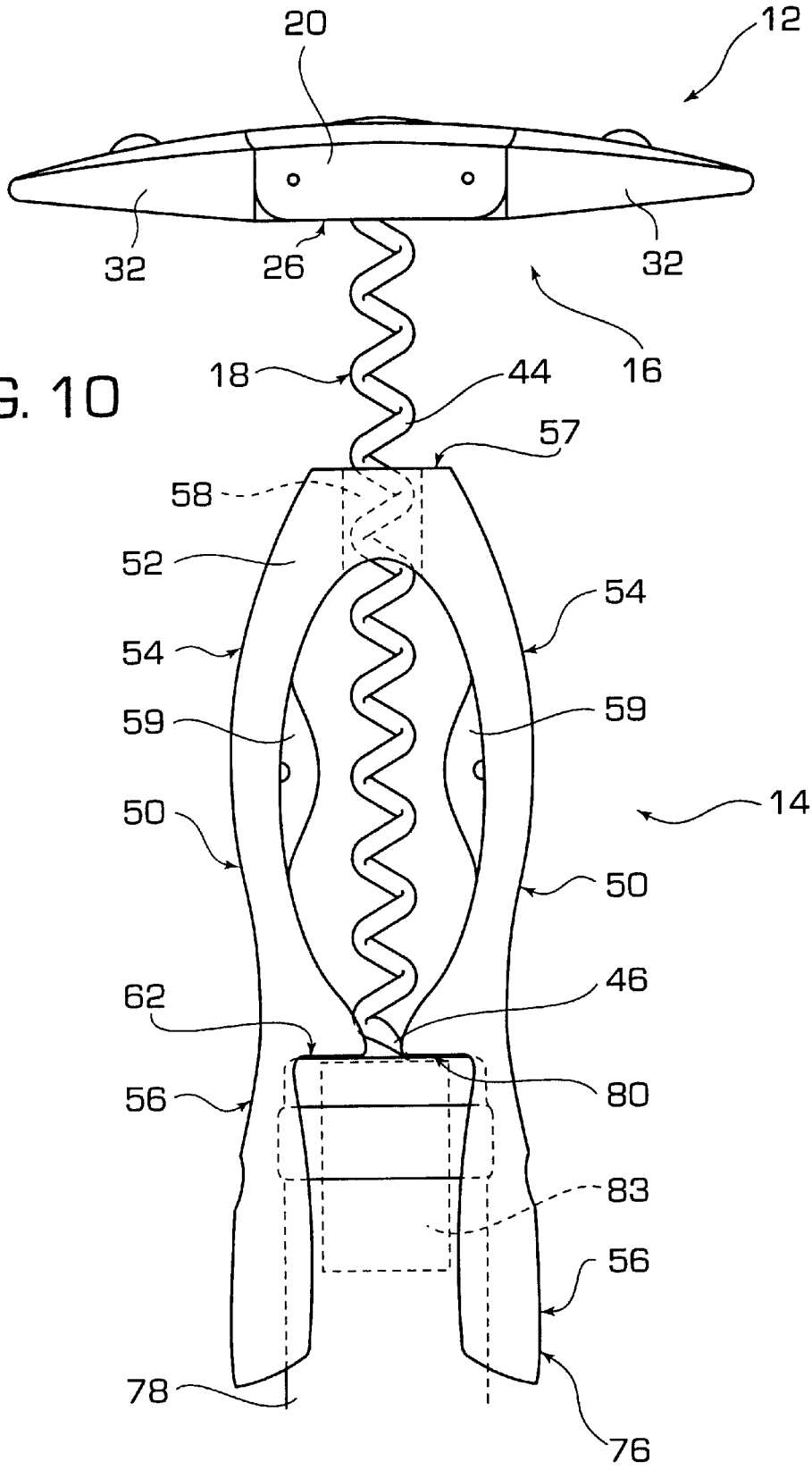
FIG. 10 is a front diagrammatic view showing the cork extractor of the present invention positioned atop the neck of a bottle in preparation for extracting a cork.
Figure 11:
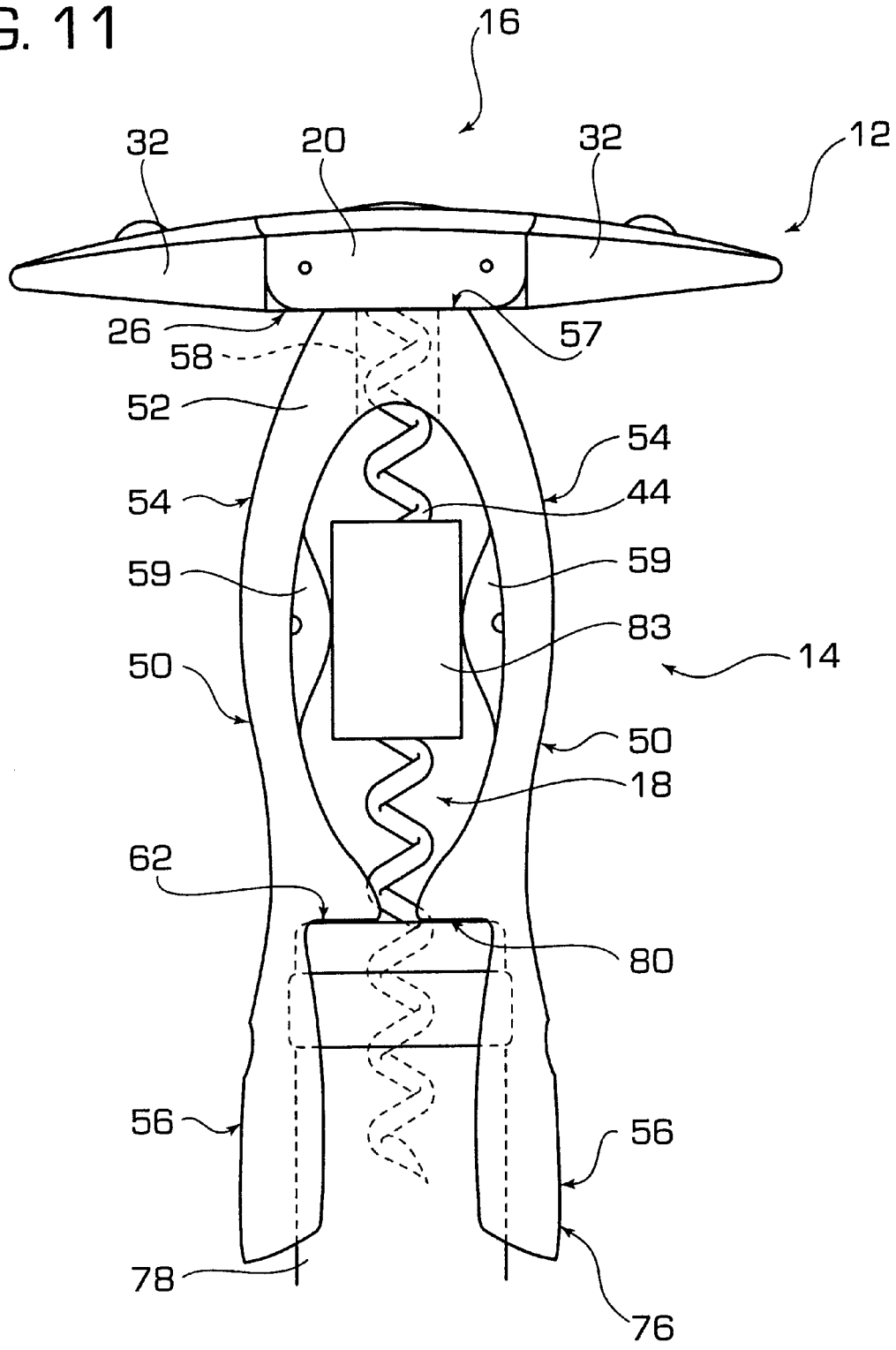
FIG. 11 is a front view of the cork extractor positioned atop the neck of a bottle after the cork has been extracted.

FIGS. 10 & 11 illustrate how the present invention extracts cork 83 from bottle 76. The method to be described is a conventional one for self-pulling corkscrews, and is provided herein for the sake of completeness.

As shown in FIG. 10, guide 14 is positioned with its longitudinal axis parallel with the longitudinal axis of bottle 76. Worm 18 of corkscrew 12 is inserted through aperture 58 with free end 46 positioned at or above reaction surface 62 (this orientation of corkscrew 12 will be referred to as the "operating orientation"). Lower portions 56 of guide 14 are lowered around neck 78 of bottle 76 until lip 80 abuts reaction surface 62. As stated above, arms 50 are radially flexible to allow them to be inwardly squeezed so as to prevent rotation of bottle 76 while cork 83 is being extracted. In addition, it allows guide 14 to expand or contract radially to accommodate a variety of bottle neck sizes and shapes.

Handle 16 is then rotated and downward pressure is applied thereto, driving free end 46 of worm 18 into cork 83, thereby drawing the corkscrew downwardly into guide 14.

Referring now to FIG. 11, the downward movement of corkscrew 12 eventually results in lower surface 26 of center portion 20 of handle 16 abutting top To surface 57 of head 52. Continued rotation of handle 16 causes cork 83 to be upwardly drawn along body 44 of worm 18 into upper portions 54 of guide 14 without further downward movement of corkscrew 12. Handle 16 is preferably rotated until cork 83 is positioned between flanges 59, which prevent radial rotation of cork 83. At this point, guide 14 can be removed from the neck of bottle 76 and rotation of handle 16 is reversed, withdrawing worm 18 from cork 83.

In accordance with a major feature of the present invention, when it is desired to store or transport the cork extractor, corkscrew 12 can be conveniently stored within guide 14 in a safe, easy and elegant manner.

Figure 12:
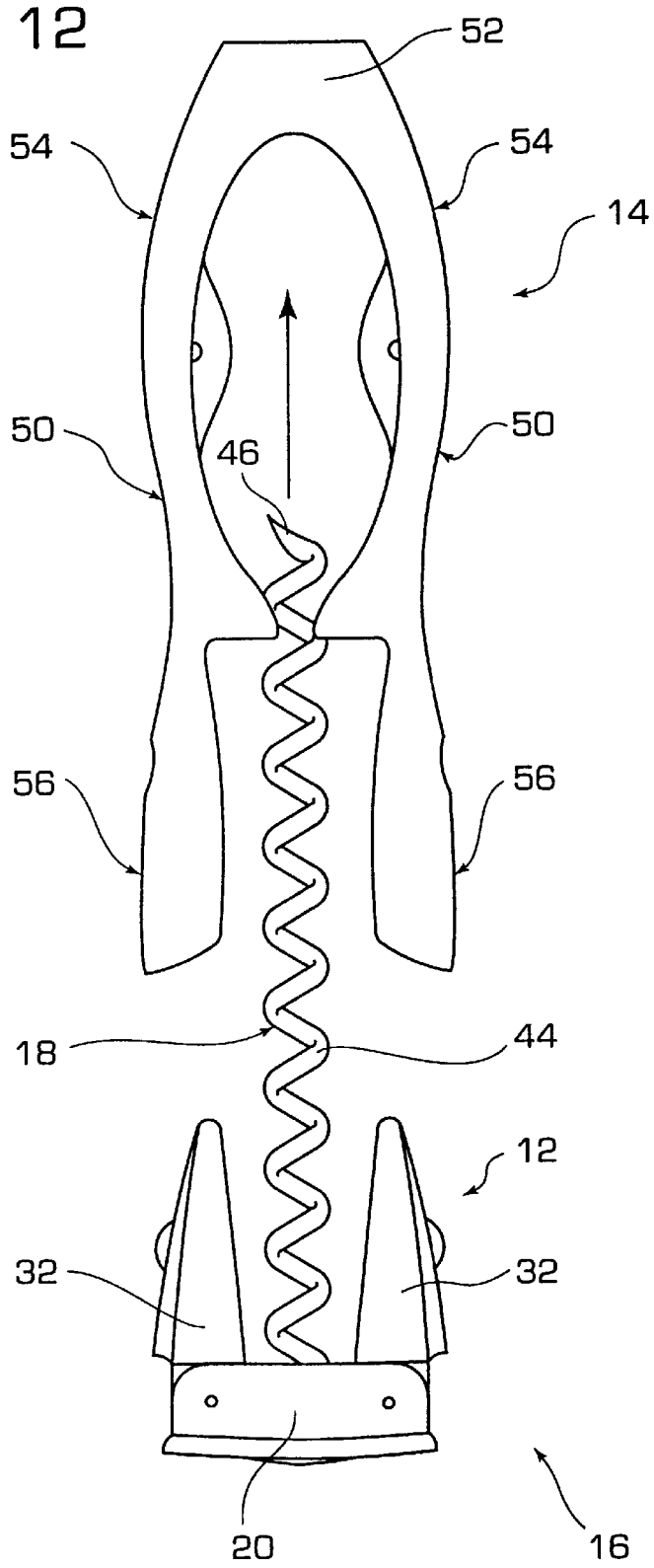
FIG. 12 is an exploded view of the cork extractor showing the corkscrew being inserted into the guide for storage or transport.
Figure 13:
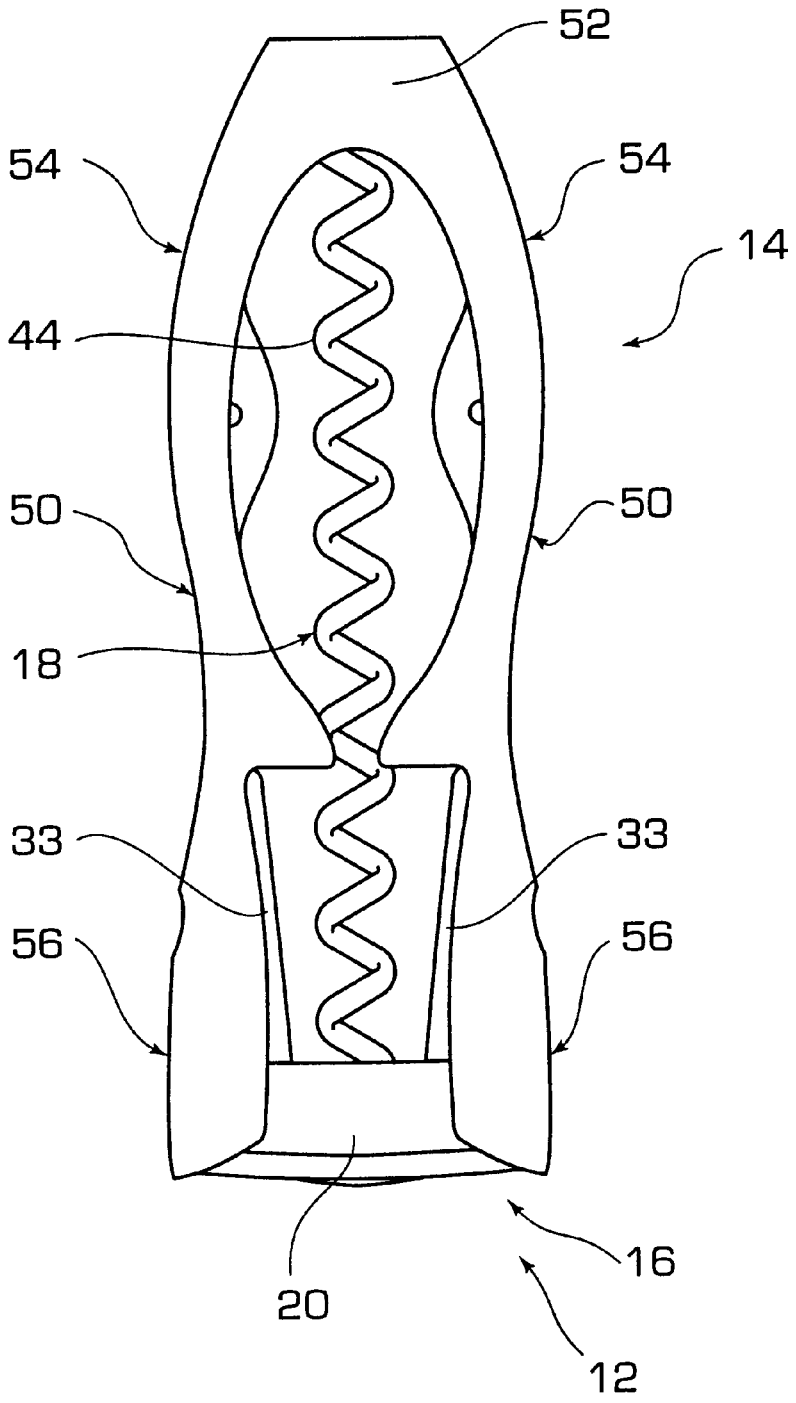
FIG. 13 is a front view of the cork extractor showing the corkscrew completely retained within the guide during storage and transport.

FIG. 12 shows how corkscrew 12 is initially inserted into guide 14 for transport or storage, and FIG. 13 shows its final stored position. Before storing corkscrew 12 in guide 14, end portions 32 of handle 16 must be folded. Then, as shown in FIG. 12, corkscrew 12 is oriented 180 degrees from its operating orientation, and free end 46 is placed between lower portions 56 of arms 50 and is moved towards head 52.

Figure 14:
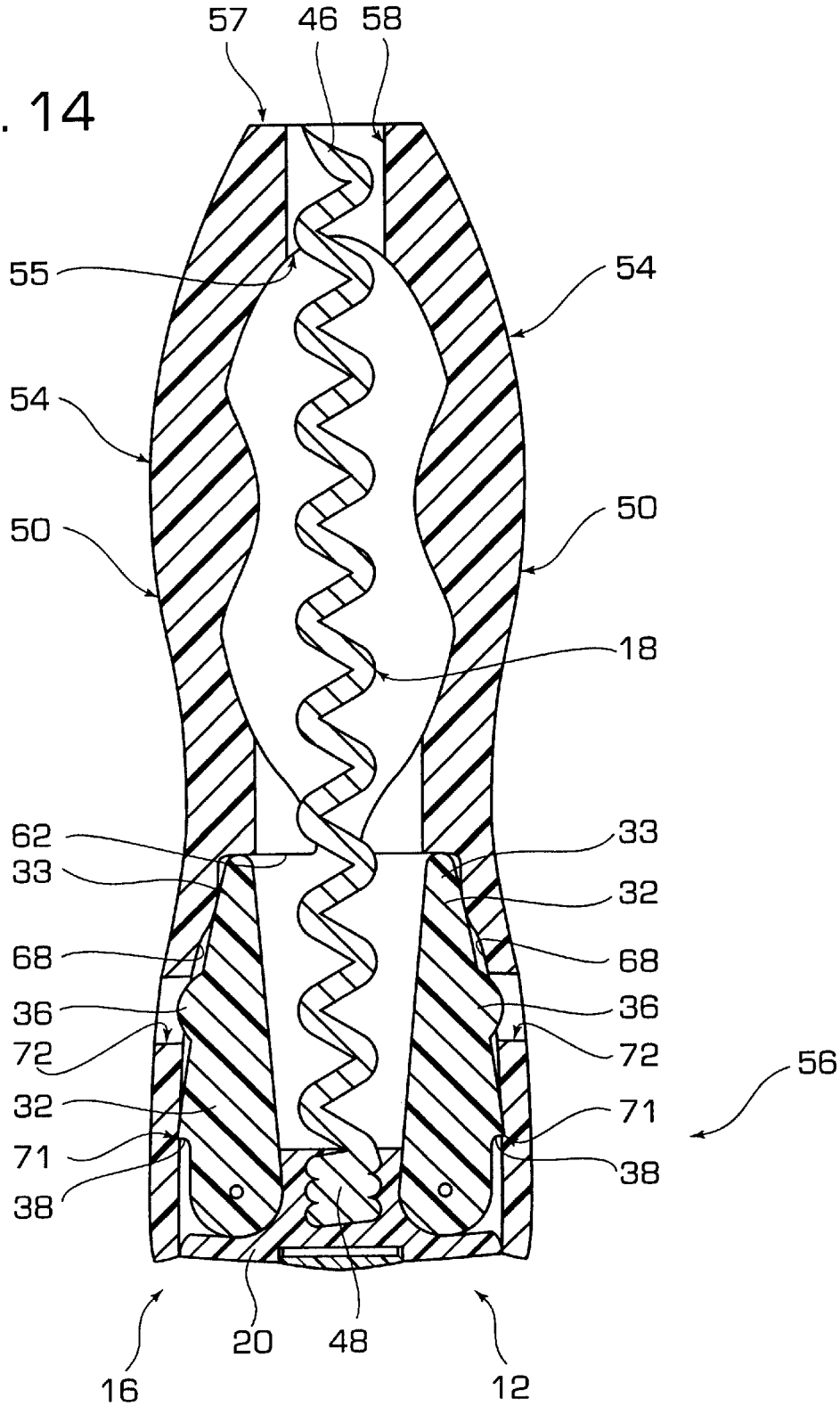
FIG. 14 is a longitudinal sectional view of the cork extractor of FIG. 13.

As perhaps best shown in FIG. 14, when being inserted into guide 14, each folded end portion 32 of handle 16 fits within a recess 68. In addition, each groove 74 (see FIG. 6) receives and guides a nib 36 towards an aperture 72. Corkscrew 12 is further inserted until each nib 36 is aligned and resting within an aperture 72. In this position, a portion of each end surface 38 has also been moved beyond and thus rests adjacent one of the arcuate ridges 71, which further serves to hold corkscrew firmly but removably in place within guide 14. It may be said that the end portions 32 have been "snapped" into place within recesses 68. At this point, free end 46 of worm 18 is fully contained within aperture 58, and is safely located in its storage position between top surface 57 and lower surface 55 of head 52. As stated above, the diameter of aperture 58 is preferably only slightly larger than that of worm 18, thereby preventing free end 46 from injuring the user of the cork extractor during storage or transport. When in the storage position, corkscrew 12 is preferably retained entirely within guide 14. Of course, it is within the purview of this invention to allow handle 16 to protrude slightly beyond guide 14, as shown in FIG. 14, since handle 16 does not contain any sharp edges or points.

In the storage or transport position shown in FIGS. 13 and 14, the present invention may be easily and safely stored in one's pocket, or in a drawer, without fear of being cut when it comes time to use it again. Thus, the cork extractor of the present invention provides a compact and safe configuration for storage and transport. It is clear from the foregoing that the objects of the invention have been fulfilled.

Those skilled in the art will appreciate that the conceptions, upon which this disclosure is based, may readily be utilized as a basis for the designing of other structures, methods and systems for carrying out the several purposes of the present invention, it is important, therefore, that the claims be regarded as including such equivalent constructions insofar as they do not depart from the spirit and scope of the present invention as defined in the appended claims.

I claim as my invention:

1. An apparatus for extracting a cork from the neck of a bottle, comprising:

a guide having a longitudinal axis and including an upper portion and a lower portion, said lower portion adapted to engage said neck of said bottle;

a corkscrew including a handle and a worm, said worm having a free end terminating in a sharp tip adapted to be inserted first through said upper portion and then through said lower portion of said guide so as to be screwed into said cork;

said guide having a recess for retaining said handle during storage or transport thereof so that said tip is positioned within said upper portion;

wherein said handle comprises a center portion and two end portions pivotally attached to said center portion, said end portions being folded during storage or transport; and wherein said end portions fold towards said free end of said worm during storage or transport;

wherein said end portions each include a nib which is adapted to mate with a hole in said lower portion of said guide during storage or transport.

2. The apparatus of claim 1, wherein said guide includes two recesses adapted to receive said end portions of said handle during storage or transport.

3. The apparatus of claim 2, wherein said guide further comprises two opposing arms that encompass said upper portion of said guide and said lower portion of said guide, each of said arms including an inner surface, one of said recesses being located on said inner surface of each arm in said lower portion of said guide.

4. The apparatus of claim 3, wherein each of said recesses is shaped similar to the shape of said end portion of said handle when said handle is retained within said lower portion of said guide during storage or transport.

5. The apparatus of claim 4, wherein each of said holes is located in a respective one of said recesses and is adapted to mate with one of said nibs when said handle is retained within said lower portion.

6. The apparatus of claim 5, wherein said upper portion includes a top surface, a bottom surface and an aperture extending from said top surface to said bottom surface, said tip of said worm being positioned within said aperture between said top surface and said bottom surface during storage or transport.

7. A cork extractor comprising:

a guide having a longitudinal axis and including an upper portion and a lower portion adapted to engage a neck of a bottle positioned along said axis;

a foil cutting blade integrally positioned in said upper portion of said guide; and a corkscrew movable in said guide.

8. The cork extractor of claim 7 wherein said foil cutting blade includes at least one cutting blade, said blade being longitudinally oriented with respect to said longitudinal axis of said guide.

9. The cork extractor of claim 8, wherein said foil cutting blade includes two cutting blades.

10. The cork extractor of claim 8, wherein said foil cutting blade includes four cutting blades.

11. The cork extractor of claim 8, wherein said guide further includes a pair of inwardly-facing, opposing flanges located on said upper portion of said guide.

12. The cork extractor of claim 11, wherein each of said flanges includes at least one substantially flat surface which is generally located in the same plane as the surface on the other of said flanges.

13. A cork extractor comprising:

a guide having two opposing elongated arms and a head, said arms being joined at said head, each of said arms having a lower portion, said lower portions being adapted to receive the neck of a bottle;

a corkscrew including a handle having a lower surface and a worm extending from said lower surface of said handle and terminating in a free end having a sharp tip;

said head of said guide including an aperture adapted to receive said worn of said corkscrew therethrough; and said corkscrew movable between a cork extracting position wherein said corkscrew extends through said aperture and said tip is located between said lower portions of said arms, and a storage position;

wherein said corkscrew is inverted with respect to said guide when moved from said cork extracting position to said storage position.

14. The cork extractor of claim 13, wherein said tip is located within said aperture when said corkscrew is in said storage position.

15. The cork extractor of claim 14, wherein said handle is located in said lower portions of said arms when said corkscrew is in said storage position.

16. The cork extractor of claim 13, wherein said head includes a top surface and a bottom surface, said aperture extending from said top surface to said bottom surface, said tip of said worm being positioned within said aperture between said top surface and said bottom surface during storage or transport.

17. The cork extractor of claim 13, wherein said handle includes portions which are folded when said corkscrew is in said storage position.

18. The cork extractor of claim 17, wherein said handle comprises a center portion and two end portions pivotally attached to said center portion, said end portions being folded when said corkscrew is in said storage position.

19. The cork extractor of claim 18, wherein said end portions fold towards said free end of said worm when said corkscrew is moved from said cork extracting position to said storage position.

20. The cork extractor of claim 19, wherein said end portions each include a nib and each of said lower portions of said arms include a hole, each of said nibs being adapted to mate with a respective one of said holes when said corkscrew is in said storage position.

21. The cork extractor of claim 20, wherein each of said lower portions of said arms includes a recess adapted to receive a respective one of said end portions of said handle when said corkscrew is in said storage position.

22. The cork extractor of claim 21, wherein each of said recesses is shaped similar to the shape of said end portions of said handle.

23. The cork extractor of claim 13, wherein each of said arms includes an upper portion located between said lower portion and said head, and said cork extractor further comprises a first foil cutting blade integrally positioned in one of said upper portions.

24. The cork extractor of claim 23, further comprising a second foil cutting blade integrally positioned in the other of said upper portions.

25. The cork extractor of claim 24, further comprising third and fourth foil cutting blades, each integrally positioned in a respective one of said upper portions.

26. The cork extractor of claim 23, further comprising a pair of inwardly-facing, opposing flanges, each of said flanges being located on a respective one of said upper portions.

27. The cork extractor of claim 26, wherein each of said flanges includes at least one substantially flat surface which is generally located in the same plane as said one substantially flat surface of the other of said flanges.

28. A cork extractor comprising:

a guide having two opposing elongated arms and a head, said arms being joined at said head, each of said arms having a lower portion, said lower portions being adapted to receive the neck of a bottle;

a corkscrew including a handle and worm;

said handle having a lower surface, a center portion and two end portions which flank said center portion and are pivotable with respect to said center portion;

said worm extending from said lower surface of said handle and terminating in a free end having a sharp tip;

said corkscrew being movable between a cork extracting position and a storage position; and said head including an aperture adapted to receive said worm of said corkscrew therethrough in said cork extracting position;

wherein said handle is inverted with respect to said guide when moved from said cork extracting position to said storage position.

29. The cork extractor of claim 28, wherein said end portions are pivoted inwardly towards said worm when said corkscrew is moved from said cork extracting position to said storage position.

30. An apparatus for extracting a cork from the neck of a bottle, comprising:

a guide having two opposing elongated arms, each of said arms including a hole formed thereon; and a corkscrew including a handle and a worm adapted to be positioned in said guide, said handle including two nibs formed thereon;

wherein said handle is adapted to be inserted between said arms so that each of said nibs mates with a respective one of said holes.

31. The apparatus of claim 30, wherein said handle includes a center portion and two end portions which flank said center portion, each of said nibs being formed on a respective one of said end portions.

32. The apparatus of claim 31, wherein said end portions are pivotable with respect to said center portion between a folded position and an unfolded position.

33. The apparatus of claim 32, wherein said end portions are pivoted into said folded position when said handle is inserted between said arms.

* * * * *

UNITED STATES PATENT AND TRADEMARK OFFICE
Certificate

Patent No. 6,151,992 Patented: November 28, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert W. Larimer, New York, NY; and Edward Kilduff, New York, NY.

Signed and Sealed this Third Day of December 2002.

JOSEPH J. HAIL III
*Supervisory Patent Examiner*
Art Unit 3723